United States Patent [19]

Ryan

[11] Patent Number: 4,605,486

[45] Date of Patent: Aug. 12, 1986

[54] COAL LIQUEFACTION PROCESS WITH INCREASED NAPHTHA YIELDS

[75] Inventor: Daniel F. Ryan, Friendswood, Tex.

[73] Assignee: Exxon Research and Engineering Co., Florham Park, N.J.

[21] Appl. No.: 727,976

[22] Filed: Apr. 26, 1985

[51] Int. Cl.[4] ..... C10G 1/00

[52] U.S. Cl. ..... 208/412; 208/416; 208/417

[58] Field of Search ..... 208/8 LE, 9, 61, 10

[56] References Cited

U.S. PATENT DOCUMENTS

| | | | |
|---|---|---|---|
| 2,873,245 | 2/1959 | Thompson et al. | 208/61 |
| 3,645,885 | 2/1972 | Harris et al. | 208/8 LE |
| 3,726,784 | 4/1973 | Correa et al. | 208/8 LE |
| 3,812,028 | 5/1974 | Wennerberg et al. | 208/61 |
| 4,081,351 | 3/1978 | Heinemann | 208/8 LE |
| 4,133,646 | 1/1979 | Farcasiu et al. | 208/8 LE |
| 4,264,428 | 4/1981 | Schoennagel et al. | 208/8 LE |
| 4,311,578 | 1/1982 | Fant et al. | 208/8 LE |
| 4,332,666 | 6/1982 | Bauman et al. | 208/8 LE |
| 4,347,117 | 8/1982 | Bauman et al. | 208/8 LE |

OTHER PUBLICATIONS

U.S. Department of Energy Report No. FE-2566-30, Aug. 1979, and No. FE-2566-42, Oct. 1980, UOP, Inc.

*Primary Examiner*—John Doll
*Assistant Examiner*—Lance Johnson
*Attorney, Agent, or Firm*—Wayne Hoover

[57] ABSTRACT

An improved process for liquefying solid carbonaceous materials wherein the solid carbonaceous material is slurried with a suitable solvent and then subjected to liquefaction at elevated temperature and pressure to produce a normally gaseous product, a normally liquid product and a normally solid product. The normally liquid product is further separated into a naphtha boiling range product, a solvent boiling range product and a vacuum gas-oil boiling range product. At least a portion of the solvent boiling-range product and the vacuum gas-oil boiling range product are then combined and passed to a hydrotreater where the mixture is hydrotreated at relatively severe hydrotreating conditions and the liquid product from the hydrotreater then passed to a catalytic cracker. In the catalytic cracker, the hydrotreater effluent is converted partially to a naphtha boiling range product and to a solvent boiling range product. The naphtha boiling range product is added to the naphtha boiling range product from coal liquefaction to thereby significantly increase the production of naphtha boiling range materials. At least a portion of the solvent boiling range product, on the other hand, is separately hydrogenated and used as solvent for the liquefaction. Use of this material as at least a portion of the solvent significantly reduces the amount of saturated materials in said solvent.

2 Claims, 1 Drawing Figure

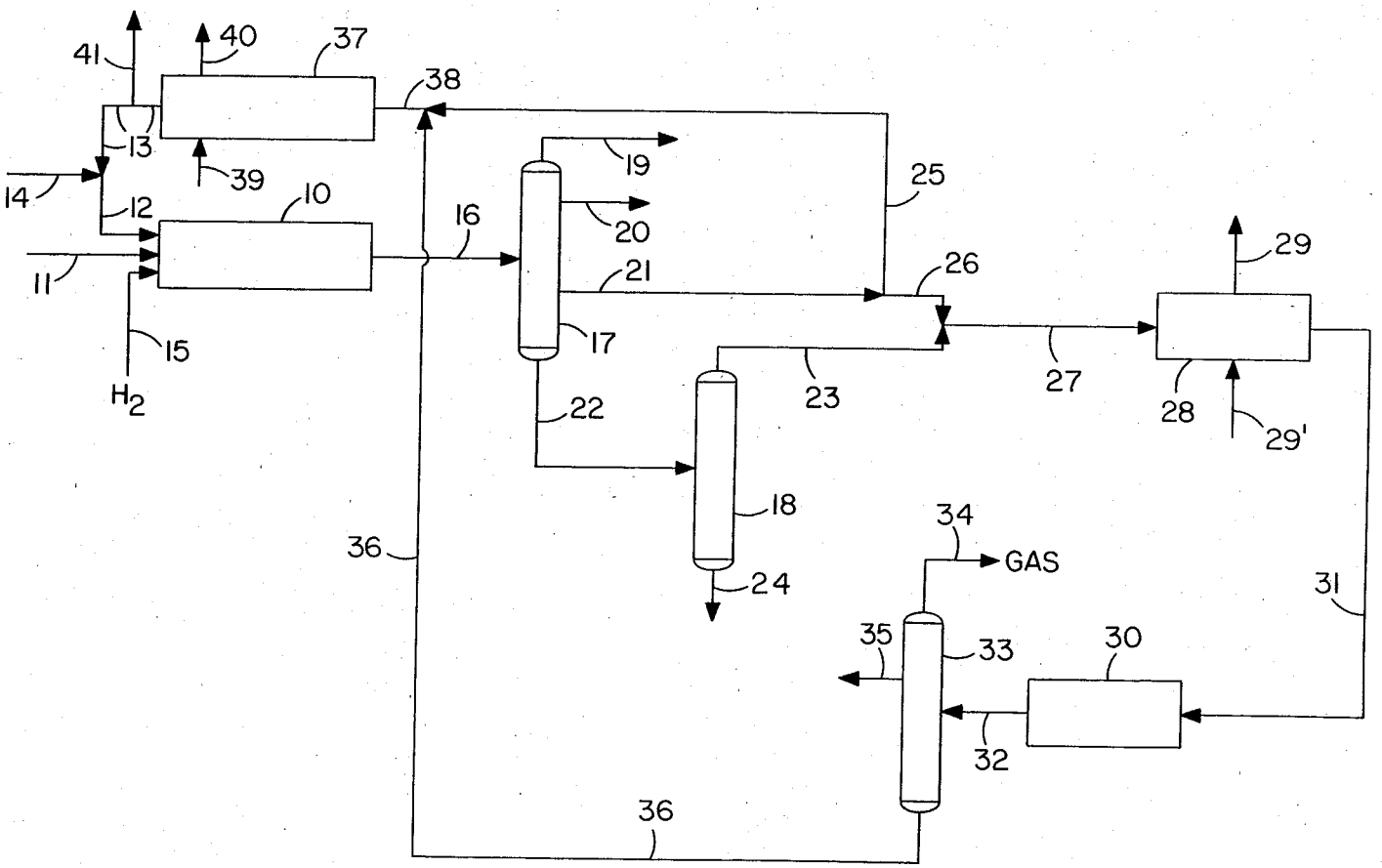
FIGURE

COAL LIQUEFACTION PROCESS WITH INCREASED NAPHTHA YIELDS

The Government of the United States of America has rights in this application pursuant to Cooperative Agreement No. DE-FC01-77-ET-10069 (formerly) EF-77-A-01-2893) awarded by the U.S. Energy Research and Development Administration, now the U.S. Department of Energy.

BACKGROUND OF THE INVENTION

This invention relates to an improved process for converting coal or similar solid carbonaceous materials. More particularly, this invention relates to an improved process for liquefying coal and similar solid carbonaceous materials.

As is well known, coal has long been used as a fuel in many areas. For several reasons, however, such as handling problems, waste disposal problems, pollution problems and the like, coal has not been a particularly desirable fuel from the ultimate consumers point of view. Moreover, coal cannot be used directly in areas where a liquid or gaseous fuel is required. As a result, oil and gas have enjoyed a dominate position from the standpoint of fuel sources, throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously and which will permit use in those areas where liquid or gaseous fuels are normally required. To this end, several processes wherein coal is either liquefied and/or gasified have been proposed heretofore. Of these, the processes wherein coal is liquefied appear to be more desirable since a broader range or products is produced and these products are more readily transported and stored.

Of these several liquefaction processes which have been heretofore proposed, those processes wherein coal is liquefied in the presence of a solvent or diluent, particularly a hydrogen donor solvent or diluent, and a hydrogen containing gas appear to offer the greater advantages. In these processes, liquefaction is accomplished at elevated temperatures and pressures and hydrocarbon gases are invariably produced as by-products. For the most part, however, these processes result in relatively high yields of higher boiling point liquids, i.e., products boiling in the fuel oil and the vacuum gas-oil ranges. The bulk of the products obtained from these processes are, then, at best substitutes for coal in applications where coal could be used directly. Moreover, in those processes wherein a portion of the liquid product is separately hydrotreated and used as solvent, a significant amount of saturated materials may be contained therein and these, in turn, can cause operating problems such as coking in preheat furnaces. The need, therefore, for an improved liquefaction process which will permit increased yields of lighter boiling liquid products and permit operation with a solvent containing a reduced amount of saturated, naphthenic materials and higher amounts of aromatic and hydroaromatic materials is believed to be readily apparent.

SUMMARY OF THE INVENTION

It has now been discovered that the foregoing and other disadvantages of the prior art processes can be reduced with the method of the present invention and an improved liquefaction process provided thereby. It is, therefore, an object of this invention to provide an improved liquefaction process. It is another object of this invention to provide such a liquefaction process wherein the yield of lighter boiling liquids is increased. It is still a further object of this invention to provide such an improved liquefaction process wherein the amount of saturated, naphthenic components in the solvent are reduced and the amount of aromatic and hydroaromatic materials in said solvent increased. The foregoing and other objects and advantages will become apparent from the description set forth hereinafter and from the drawings appended thereto.

In accordance with the present invention, the foregoing and other objects and advantages are accomplished by liquefying a coal or similar solid carbonaceous material in the presence of a hydrogen donor solvent or diluent at elevated pressures and temperatures to produce a normally gaseous product, a normally liquid product and a normally solid bottoms product. The liquid product is then separated into a naphtha fraction, a solvent fraction and a heavy, vacuum gas-oil fraction. At least a portion of the solvent fraction and at least a portion of the vacuum gas-oil fraction is then passed through a hydrotreater and then subjected to catalytic cracking. As a result of the catalytic cracking, at least a portion of the feed to the catalytic cracker is then converted to a lower boiling naphtha fraction and another portion of the feed is converted to a material boiling generally in the coal liquefaction solvent range. The naphtha from the catalytic cracker may then be combined with the naphtha from the coal liquefaction to thereby increase the yield of naphtha boiling range product. The solvent boiling fraction from the catalytic cracker is highly aromatic (low in paraffinic and naphthenic materials) and is well suited to separate hydrogenation to produce a solvent fraction containing hydrogen donor species. The solvent boiling range fraction from the catalytic cracker may be combined with any solvent boiling range material from the coal liquefaction that was not passed to the catalytic cracker prior to the separate hydrogenation to produce hydrogen donor species. The amount of saturated, naphthenic type materials in the feed to the solvent hydrogenator is, then, lower than it would have been had only the solvent boiling range material in the coal liquefaction product been fed to the hydrogenation and, as a result, the amount of saturated, naphthenic materials in the solvent after separate hydrogenation will be less.

BRIEF DESCRIPTION OF THE DRAWING

The FIGURE is a schematic flow diagram of a process within the scope of the present invention.

DETAILED DESCRIPTION OF THE INVENTION

As indicated, supra, the present invention relates to an improved process for liquefying coal and similar solid carbonaceous materials wherein the yield of naphtha boiling range materials is increased and the amount of saturated, naphthenic components in the liquefaction solvent is reduced. The increased yield of naphtha boiling range material is achieved by passing at least a portion of the solvent boiling range material in the coal liquefaction product and at least a portion of the heavier, vacuum gas-oil first through a hydrotreater and then a catalytic cracker. The cat-cracking operation effectively acts as a purge of saturated, paraffinic materials by converting at least a portion of these materials as well as other materials in the feed to the catalytic cracker to naphtha boiling range materials. The catalytic cracking also converts at least a portion of the vacuum gas-oil into solvent boiling range material which is high in aromatics. This highly aromatic, solvent boiling range material may then be separately hydrogenated so as to produce liquefaction solvent containing hydrogen donor species.

In general, the method of the present invention can be used to liquefy any solid carbonaceous material which can, effectively, be hydrogenated and liquefied. The method of this invention is particularly useful in the liquefaction of coal and may be used to liquefy any of the coals known in the prior art including anthracite, bituminous coal, subbituminous coal, lignite, peat, brown coal and the like.

In general, the solid carbonaceous material will be ground to a finely divided state. The particular particle size or particle size range actually employed, however, is not critical to the invention and, indeed, essentially any particle size can be employed. Notwithstanding this, generally, the solid carbonaceous material which is liquefied in accordance with this invention will be ground to a particle size of less than about ¼ inch and preferably to a particle size of less than about 8 mesh (N.B.S. sieve size).

After the solid carbonaceous material has been sized the same will then be slurried with a hydrogen donor solvent or diluent, preferably containing at least about 0.8 wt. % donatable hydrogen. Normally, the ratio of solvent or diluent to coal (on a moisture-free basis) in the slurry will be within the range from about 0.8:1 to about 10:1 on a weight basis.

In general, any of the solvents or diluents known in the prior art to be useful in the liquefaction of a solid carbonaceous material may be used during start-up in the process of this invention and/or to offset any deficiency in preferred process derived solvent that may occur. Suitable solvents include mixtures of one or more hydrogen donor compounds. Compounds which will donate hydrogen during liquefaction are believed well known in the prior art and many are described. in U.S. Pat. No. 3,867,275. These include the indanes, the dihydronaphthalenes, the $C_{10}$–$C_{12}$ tetrahydronaphthalenes, the hexahydrofluorenes, the dihydro-tetrahydro-hexahydro- and octahydrophenanthrenes, the $C_{12}$–$C_{13}$ acenaphthenes, the tetrahydro-hexahydro-and decahydropyrenes, the di-tetra-and octohydroanthracenes and other derivatives of partially saturated aromatic compounds. Particularly effective mixed solvents include hydrogenated creosote oil and solvents derived from the liquefaction of coal (process derived solvents), particularly distillate fractions having an initial boiling point within the range from about 350° F. to about 425° F. and a final boiling point within the range from about 700° F. to about 900° F., which distillate fractions are separately hydrogenated to contain at least 25 wt. % of hydrogen donor species.

After the solid carbonaceous material has been slurried, the slurry will then be subjected to liquefaction at a temperature within the range from about 700° to about 950° F. and at a pressure within the range from about 650 psig to about 3000 psig. During liquefaction, at least a portion of the solid carbonaceous material will be converted to a normally gaseous product, another part will be converted to a normally liquid product and a still further part will be converted and/or remain as a normally solid bottoms product. Any number of liquefaction stages or zones may be used to effect the liquefaction. The total nominal holding time will, generally, range from about 10 to about 200 minutes although, when multiple stages are employed, total nominal holding times in excess of 200 minutes may be employed.

Following liquefaction, the liquefaction effluent will then be separated into its respective phases using conventional techniques. For example, the gaseous product may be simply flashed overhead and the liquid and solids then separated using filtration, centrifugation or distillation. Of these, distillation is preferred.

After separation, the gaseous product may be upgraded to a pipeline gas or the same may be burned to provide energy for the liquefaction process. Alternatively, all or a portion of the gaseous product may be reformed to provide hydrogen for the liquefaction process or sold as fuel.

Similarly, all or a portion of the normally solid product may be burned directly as a fuel to produce energy for the liquefaction process or gasified to produce either an intermediate btu fuel-gas or hydrogen for use in the liquefaction process or simply discarded. Alternatively, at least a portion of the bottoms could be recycled in an effort to increase the total conversion thereof in the liquefaction operation.

In general, the liquid product will be further separated, preferably via distillation, into a naphtha boiling range material, a solvent boiling range material and a heavier, vacuum gas-oil material. Generally, the naphtha boiling range material will be withdrawn as a product and a portion of both the solvent boiling range material and the vacuum gas-oil may also be withdrawn as products. In accordance with the improved method of the present invention, however, at least a portion of the solvent boiling fraction, preferably the product portion thereof, and at least a portion of the vacuum gas-oil fraction will be combined and passed first to a hydrotreater and then to a catalytic cracker.

In the hydrotreater, the combined solvent boiling range material and vacuum gas-oil will be contacted with a hydrogenation catalyst at a temperature within the range from about 600° F. to about 850° F. at a pressure within the range from about 1000 psig to about 2000 psig. The hydrogen treat rate in the hydrotreater generally will be within the range from about 3000 to about 10,000 scf/bbl. Any of the known hydrogenation catalyst may be employed in the hydrotreater. Particularly effective catalysts include those comprising one or more Group VIII non-noble or iron group metals in combination with one or more Group VI-B metals of the Periodic Table of Elements. Generally, such catalyst will be supported on alumina, silica-alumina or a similar support. Particularly effective combinations comprise the oxide or sulfide form of the Group VIII metal in combination with the oxide or sulfide form of the Group VI metal. Particularly effective combinations include, then, the oxides and/or sulfides of cobalt-/molybdenum, nickel molybdenum, nickel tungsten, nickel/molybdenum/tungsten, cobalt/nickel/molybdenum and the like. A particularly effective cobalt-/molybdenum catalyst is one comprising from about 1 to about 10 wt. % cobalt oxide, preferably from about 2 to about 5% cobalt oxide and from about 10 to about 30 weight percent molybdenum oxide, preferably from about 15 to about 20 weight percent molybdenum oxide. A particularly effective nickel/molybdenum catalyst will comprise from about 1 to about 10 wt. % nickel oxide, preferably from about 2 to about 5 wt. % nickel oxide and from about 10 to about 30 wt. % molybdenum oxide, preferably from about 15 to about 20 wt. % molybdenum oxide. Such catalyst will, of course, be prepared in accordance with known techniques and many are available commercially.

In the hydrotreater, the aromatic and hydroaromatic compounds will be further hydrogenated and due to the relative severity of the hydrotreater, many of these compounds will be completely saturated. The hydrotreating step is important since the aromatic and polynuclear aromatic materials contained in the mixture of solvent boiling range material and vacuum gas-oil material are not easily cracked.

In the catalytic cracker, the effluent from the hydrotreater will be contacted with a catalytic cracking catalyst at a temperature within the range from about 800° F. to about 1100° F. and at a pressure within the range from about 0 to about 50 psig. In general, any of the known catalytic cracking catalysts may be used. Suitable catalytic cracking catalysts include, but are not limited to, conventional silica-alumina cracking catalyst and crystalline alumino- silicate zeolites. In a preferred embodiment, the catalytic cracker will be a conventional fluid catalytic cracker and the fluid catalyst will be regenerated in a separate burner. Suitable catalytic cracking processes include those described in U.S. Pat. Nos. 2,589,124 and 3,923,642, the disclosure of which patents are hereby incorporated herein by reference.

In the catalytic cracker, certain portions of the feed will be converted to naphtha boiling range materials and another portion of the feed will be converted to solvent boiling range materials. The naphtha product from the catalytic cracker will, generally, be of higher quality than the naphtha boiling range material separated from the liquefaction product. In this regard, it should be noted that the naphtha is well suited for use as a motor gasoline blendstock and products having research octanes as high as 97 RON have been demonstrated. Notwithstanding that this naphtha product is, generally, of higher quality than the naphtha boiling range product from the liquefaction, the two naphtha products can be combined and then further upgraded to yield a high quality gasoline. The solvent boiling range product from the catalytic cracker, on the other hand, will be highly aromatic containing from about 90 to about 100 wt. % polynuclear aromatic compound and about 0 to about 10 wt. % saturate, paraffinic type compounds. At least a portion of the solvent boiling range material from the catalytic cracker will be passed to the solvent hydrotreater. Generally, that portion of the solvent boiling range material from the catalytic cracker which is to be used as solvent will be combined with that portion of solvent boiling range material from the liquefaction product and passed to a separate hydrogenation unit to convert at least a portion of the aromatic components to a corresponding hydroaromatic component which is, in turn, capable of donating hydrogen during liquefaction.

In general, any of the known hydrogenation catalyst may be used to effect the hydrogenation of the solvent or distillate fraction in accordance with this invention. Particularly effective catalyst include those comprising one or more Group VIII non-noble, or iron group metals, in combination with one or more Group VI-B metals in the periodic table. Generally, such catalysts will be supported on alumina, silica alumina or a similar support. Particularly effective combinations comprise the oxide or sulfide form of the Group VIII metal in combination with the oxide or sulfide form of the Group VI metal. Particularly effective combinations include, then, the oxides and/or sulfides of cobalt-molybdenum, nickel-tungsten, nickel-molybdenum-tungsten, cobalt-nickel-molybdenum and the like. A particularly effective cobalt-molybdenum catalyst is one comprising from about 1 to about 10 wt. % cobalt oxide, preferably from about 2 to about 5% cobalt oxide, and from 10 to about 30 weight percent molybdenum oxide, preferably from about 15 to about 20 weight percent molybdenum oxide. A particularly effective nickel-molybdenum catalyst will comprise from about 1 to about 10 wt. % nickel oxide, preferably from about 2 to about 5 wt. % nickel oxide, and from about 10 to about 30 wt. % molybdenum, preferably from about 15 to about 20 wt. % molybdenum oxide. Such catalysts will, of course, be prepared in accordance with known techniques and many are available commercially.

It is, of course, within the scope of the present invention to pass all of the solvent boiling range material from both the catalytic cracker and any portion of that from the liquefaction product which was not passed to the hydrotreater and the catalytic cracker through the solvent hydrogenation zone and thereafter separating any excess solvent boiling range material as product. Moreover, it is within the scope of the present invention to feed a broader boiling range material to the solvent hydrogenation step and thereafter separate the desired solvent boiling range material therefrom.

PREFERRED EMBODIMENT

In a preferred embodiment of the present invention, coal will be liquefied at a temperature within the range from about 800° F. to about 880° F. and the pressure will be controlled within the range from about 1500 psig to about 2500 psig to produce an effluent containing a normally gaseous product, a normally liquid product and a normally solid bottoms product. The effluent will then be separated into its three phases and the liquid product will be further separated to yield a naphtha boiling range product having an initial boiling point within the range from about 50° F. to about 100° F. and a final boiling point within the range from about 300° F. to about 450° F.; a solvent boiling range product having an initial boiling point within the range from about 300° F. to about 450° F. and a final boiling point within the range from about 750° F. to about 850° F. and a vacuum gas-oil having an initial boiling point within the range from about 750° F. to about 850° F. and a final boiling point within the range from about 950° F. to about 1050° F. The solvent boiling range material will then be separated into two portions. The first portion, which will constitute from about 80 wt. % to about 95 wt. % of the total will be separately hydrogenated and at least a portion thereof recycled as solvent. The remaining portion, which will be from about 5 wt. % to about 20 wt. % of the total will be combined with from about 50 wt. % to about 100 wt. % of the vacuum gas-oil fraction and passed to a hydrotreater and then to a fluid catalytic cracker. Splitting of the solvent boiling range material into two fractions will, generally, be made in such a way as to maintain solvent balance, although an extraneous solvent could be used to offset any deficiency of process derived solvent. In the hydrotreater, the solvent and vacuum gas-oil fractions will be contacted with molecular hydrogen at a temperature within the range from about 650° F. to about 750° F. at a pressure within the range from about 1250 psig to about 2000 psig in the presence of a hydrogenation catalyst which will, preferably, be a supported catalyst comprising from about 2 to about 5 wt. % cobalt or nickel and from about 15 to about 20 weight percent molybdenum oxide. The effluent from the hydrotreater will then be passed to a fluid catalytic cracker which will be operated at a temperature within the range from about 900° F. to about 1100° F. and at a pressure within the range from about 20 psig to about 35 psig. In the fluid catalytic cracker, the feed will be cracked in the presence of a fluidized cracking catalyst which will, preferably, be a crystalline alumino-silicate zeolite. In the catalytic cracker, from about 40 wt. % to about 60 wt. % of the feed thereto will be cracked to a naphtha boiling range material. The remainder will be cracked to a solvent boiling range material. The naphtha fraction will be withdrawn as product and may be combined with the naphtha fraction separated from the liquefaction, liquid product or recovered separately as product. The solvent boiling range fraction will be passed to a separate hydrotreater and will, generally, be combined with that portion of the solvent boiling range fraction separated from the liquefaction, liquid product for use as a solvent.

It is believed that the invention will be better understood by reference to the attached figure which illustrates a particularly preferred embodiment. Referring then to the figure, a finely divided coal or similar solid carbonaceous material is introduced into liquefaction vessel 10 through line 11 and slurried with a hydrogen donor solvent or diluent introduced through line 12. In a preferred embodiment, the solvent will be derived from the solid being subjected to liquefaction, will be separately hydrogenated so as to contain at least about 45 wt. % hydrogen donor species and will be recycled to the mixing vessel through line 13—13. During start-up, however, or when a recycle solvent is not employed, any of the known useful hydrogen donor solvents or diluents may be introduced into line 12 through line 14.

In the liquefaction vessel 10, the solid carbonaceous material is at least partially liquefied and, generally, at least partially gasified in the presence of molecular hydrogen introduced through line 15. The liquefaction vessel will be sized so as provide a nominal holding time within the range from about 20 to about 200 minutes, preferably 40 to about 140 minutes, and while a single vessel has been illustrated, a plurality of vessels may be employed. The temperature during liquefaction will be within the range from about 700° to about 950° F., preferably 800° F. to about 880° F. and the pressure will be within the range from about 650 psig to about 3000 psig, preferably within the range from about 1500 psig to about 2500 psig.

In the embodiment illustrated, the combined effluent from the liquefaction vessel 10 is withdrawn through line 16 and passed to a suitable separation means. In the embodiment illustrated, the separating means comprises an atmospheric distillation column 17 and a vacuum distillation column 18. The normally gaseous product is withdrawn from the atmospheric distillation column through line 19, a naphtha boiling range product is withdrawn through line 20 and a solvent boiling range product is withdrawn through line 21. As indicated previously, the naphtha boiling range product will have an initial boiling point within the range from about 50° F. to about 100° F. and a final boiling point within the range from about 300° F. to about 450° F. The solvent boiling range material will have an initial boiling point within the range from about 300° F. to about 450° F. and a final boiling point within the range from about 750° F. to about 850° F. The heavier material from the atmospheric column is passed to the vacuum column through line 22. In the vacuum column, a vacuum gas-oil having an initial boiling point equal to the final boiling point of the solvent boiling range material and a final boiling point within the range from about 950° F. to about 1050° F. is withdrawn overhead through line 23. A normally solid bottoms product having an initial boiling point equal to the final boiling point of the vacuum gas-oil is withdrawn through line 24.

The solvent boiling range material may be divided into two fractions with a first portion withdrawn from line 21 through line 25 and a second portion withdrawn through line 26. The first portion may comprise from about 80 wt. % to about 95 wt. % of the total solvent boiling range material and will be separately hydrogenated for use as solvent. The second portion withdrawn through line 26 which will constitute from about 5 wt. % to about 20 wt. % of the total will be combined with the vacuum gas-oil fraction withdrawn from the vacuum distillation column through line 23 and passed to a hydrotreater through line 27.

In the hydrotreater, the solvent boiling range fraction and the vacuum gas-oil fraction is subjected to hydrotreatment at a temperature within the range from about 600° F. to about 850° F. at a pressure within the range from about 1000 psig to about 2000 psig in the presence of a suitable hydrotreating catalyst. The hydrotreating will be accomplished in the presence of molecular hydrogen introduced through line 29' at a hydrogen treat rate within the range from about 3000 to about 10,000 scf/bbl. Excess hydrogen and any gaseous products are withdrawn from the hydrotreater 28 through line 29.

The liquid effluent from the hydrotreater is then passed to a catalytic cracker 30 through line 31. In the catalytic cracker, the substantially saturated product from the hydrotreater is thermally cracked in the presence of a suitable cracking catalyst. In a preferred embodiment, the catalytic cracker will be a conventional fluid catalytic cracker and comprise means, not illustrated, for regenerating spent catalyst. The catalytic cracking will be accomplished at a temperature within the range from about 800° F. to about 1100° F. at a pressure within the range from about 0 psig to about 50 psig.

The total effluent from the catalytic cracker is withdrawn through line 32 and passed to a suitable separating means. In the embodiment illustrated, the suitable separating means is an atmospheric distillation column 33. In the embodiment illustrated, a normally gaseous product is withdrawn overhead through line 34, a naphtha boiling range product is withdrawn through line 35 and a product boiling generally in the solvent boiling range is withdrawn through line 36. For reasons believed well known in the prior art, both the naphtha boiling range and solvent boiling range product from separation means 33 are highly aromatic. In this regard, it should be noted that the naphtha boiling range material will have an initial boiling point within the range from about 50° F. to about 100° F. and a final boiling point within the range from about 300° F. to about 450° F. The solvent boiling range material will have an initial boiling point equal to the final boiling point of the naphtha boiling range material and a final boiling point within the range from about 750° F. to about 850° F.

The solvent boiling range material withdrawn through line 36 will be combined with solvent boiling range material separated from the liquefaction product and withdrawn through line 25 and passed to a solvent hydrogenation vessel 37 through line 38. In hydrogenating vessel 37, the solvent fraction is separately hydrogenated before being recycled as solvent through lines 13—13. Preferably, the hydrogenation will be accomplished catalytically at conditions known to be effective for this purpose in the prior art. In the embodiment illustrated, the hydrogenation is accomplished in hydrogenation vessel 37 with a molecular hydrogen introduced through line 39. The hydrogen actually used may be from any source, but in a preferred embodiment will be produced either from the steam reforming of at least a portion of the gaseous product from liquefaction or by gasification of at least a portion of the bottoms or of coal. In the embodiment illustrated, unreacted hydrogen and any gaseous products of hydrogenation are withdrawn through line 40. When desired, this gaseous product may be treated to recover recycled hydrogen. Also in the embodiment illustrated, the hydrogenated product is withdrawn through line 13—13. In those cases where the amount of liquid withdrawn through line 13—13 exceeds the amount of solvent required during liquefaction, any excess may be withdrawn as product through line 41.

In accordance with the improved method of the present invention, the hydrogenated solvent withdrawn through line 13—13 will contain less saturated components than would have been the case had all of the solvent boiling range material in the liquefaction product been withdrawn and separately hydrogenated for use as solvent. In this regard, it should be noted that the actual reduction in the amount of saturates contained in the solvent will depend upon the amount of solvent actually withdrawn through line 26 and passed first to the severe hydrotreater and then to the catalytic cracker. When the maximum solvent boiling range fraction possible while maintaining solvent balance is withdrawn and passed first to the hydrotreater and then to the catalytic cracker, the amount of fully saturated material in the solvent would range from about 5 to about 30 wt. % whereas when the full amount is withdrawn through line 25 and passed through the solvent hydrotreater the amount of fully saturated materials would range from about 15 wt. % to about 40 wt. % of the total solvent boiling range fraction. Also in accordance with the improved method of the present invention, from about 40 wt. % to about 60 wt. % of the solvent fraction plus vacuum gas-oil fraction will be converted to a naphtha boiling range material. This, then, significantly increases the yield of naphtha boiling range product.

Having thus broadly described the present invention and a preferred embodiment thereof, it is believed that the same will become more apparent by reference to the following examples. It will be appreciated, however, that the examples are presented solely for purposes of illustration and should not be construed as limiting the invention.

EXAMPLE 1

In this example, as Illinois coal was liquefied at a temperature of 840° F. and at a pressure of 2000 psig in the presence of molecular hydrogen at a nominal holding time of 40 minutes. The liquefaction product was then separated into a normally gaseous product, a normally liquid product, and a normally solid bottoms product. The liquid product was then separated into a naphtha boiling range material C5-400° F., a solvent boiling range material 400° F.–800° F. and a vacuum gas-oil having an initial boiling point of 800° F. and a final boiling point of 1000° F. Two parts of the solvent boiling range material were then combined with one part of VGO and passed through a severe hydrotreating step and the liquid effluent subjected to catalytic cracking in a fluid bed operation. The product from the fluid catalytic cracker had the following composition:

TABLE 1

| | |
|---|---|
| Chem Gas, Wt. % | 3.21 |
| $C_2^-$, Wt. % | 5.62 |
| Propylene, LV % | 7.13 |
| Propane, LV % | 4.42 |
| Butylenes, LV % | 3.92 |
| Isobutane, LV % | 4.24 |
| n-Butane, LV % | 1.64 |
| $C_5$-400° F. Naphtha, LV % | 47.20 |
| 400° F.$^+$ Distillate, LV % | 36.57 |
| Coke, Wt. % | 8.87 |

EXAMPLE 2

Based upon the data obtained in Example 1, the product distribution for a commercial plant wherein 10 wt. % of the solvent boiling range solvent is mixed with all of the vacuum gas-oil in a ratio of about 2:1 and passed to a hydrotreater and fluid catalytic cracker operated in the manner of Example 1 were determined and compared with the product distribution for the same commercial plant wherein all of the solvent boiling range material is separately hydrogenated and at least a portion thereof used as recycle solvent (identified in the Table as "Base Case"). The data relating to the commercial plant used in this comparison are described in Technical Progress Report No. FE-2893-61 dated March, 1981. For convenience, the comparison is summarized in the following table:

TABLE 2

| | Barrels per Stream Day | | |
|---|---|---|---|
| | Base Case | H/T plus FCC Upgrading | Combined Yields |
| $C_3$= | — | 2,260 | 2,260 |
| $C_3$ | 4,205 | 1,401 | 5,606 |
| $C_4$= | — | 1,243 | 1,243 |
| $C_4$ | 2,538 | 1,864 | 4,402 |
| EDS Naphtha | 23,060 | — | 23,060 |
| FCC Naphtha | — | 14,964 | 14,964 |
| EDS Distillate | 21,081** | (21,081) | 12,818 |
| FCC Distillate | — | 11,594* | (11,594) |
| Vacuum Gas Oil | 10,623** | (10,625) | — |

*Aromatic FCC distillate recycled to solvent hydrotreater with equivalent mass of EDS recycle solvent withdrawn as product.
**Combined and fed to hydrotreater and catalytic cracking upgrading steps.

As will be apparent from the foregoing, the yield of naphtha boiling range material can be increased by approximately 65% by passing a portion of the solvent boiling range material and the vacuum gas-oil to a hydrotreater followed by a catalytic cracker. Also, for purposes of comparison, when the distillate from the catalytic cracker is separately hydrogenated and used as a solvent, the solvent will contain only from about 5 wt. % to about 30 wt. % saturated components. This compares to from 15 to about 40 wt. % saturated components in the solvent contemplated in the commercial design described in the aforementioned publication. Operating in this way, it is reduced about 25 to about 35%.

While the present invention has been described and illustrated by reference to particular embodiments thereof, it will be appreciated by those of ordinary skill in the art that the same lends itself to variations not necessarily illustrated herein. For this reason, then, reference should be made soley to the appended claims for purposes of determining the true scope of the present invention.

What is claimed is:

1. A process for liquefying solid carbonaceous materials comprising the steps of:

(a) forming a slurry of finely divided solid carbonaceous material and a suitable solvent or diluent;

(b) subjecting the slurry from step (a) to liquefaction at an elevated temperature and pressure in the presence of molecular hydrogen to produce a normally gaseous product, a normally liquid product and a normally solid bottoms product;

(c) separating the product from step (b) into a gas phase, a liquid phase and a normally solid phase and further separating the liquid portion of the product into a naphtha boiling range product having an initial boiling point within the range from about 50° F. to about 100° F. and a final boiling point within the range from about 300° F. to about 450° F., a solvent boiling range product having an initial boiling point within the range from about 300° F. to about 450° F. and a final boiling point within the range from about 750° F. to about 850° F., and a vacuum gas-oil boiling range product having an initial boiling point equal to the final boiling point of the solvent boiling range material and a final boiling point within the range from about 950° F. to about 1050° F.;

(d) combining from about 5 wt % to about 20 wt % of the solvent boiling range product with from about 50 wt % to about 100 wt % of the vacuum gas-oil boiling range product and passing the mixture first to a hydrotreater and then to a catalytic cracker;

(e) separating the product from the catalytic cracker into a naphtha boiling range product and a solvent boiling range product;

(f) combining the solvent boiling range product from the catalytic cracker with the solvent boiling range materials separated from the liquid product; and (g) hydrotreating the combined solvent boiling range streams.

2. The process of claim 1 wherein the hydrotreatment accomplished in step (d) is accomplished at a temperature within the range from about 650° F. to about 850° F. at a pressure within the range from about 1000 psig to about 2000 psig and at a hydrogen treat rate within the range from about 3000 to about 10,000 scf/bbl.

* * * * *